United States Patent [19]

Stephenson

[11] 4,420,201

[45] Dec. 13, 1983

[54] SHIELDING ASSEMBLY ENCLOSING AN ELECTRICAL CONNECTOR TERMINATING SHIELDED CABLE

[75] Inventor: Brian D. Stephenson, Camp Hill, Pa.

[73] Assignee: AMP Incorporated, Harrisburg, Pa.

[21] Appl. No.: 319,347

[22] Filed: Nov. 9, 1981

[51] Int. Cl.[3] ..... H01R 13/648

[52] U.S. Cl. ..... 339/14 R; 339/143 R; 29/432; 29/451

[58] Field of Search ..... 339/97 C, 17 F, 136 R, 339/136 M, 143 R, 176 MF, 138, 14 R, 14 P; 174/84 C; 29/432, 521

[56] References Cited

U.S. PATENT DOCUMENTS

| | | | |
|---|---|---|---|
| Re. 27,743 | 8/1973 | Weimer | 174/94 R |
| 3,138,658 | 6/1964 | Weimer | 174/94 |
| 3,247,316 | 4/1966 | Weimer | 174/94 |
| 3,329,925 | 7/1967 | Johnson et al. | 339/91 |
| 3,504,101 | 3/1970 | Muto | 174/94 |
| 3,541,226 | 11/1970 | Cea et al. | 174/84 |
| 3,541,227 | 11/1970 | Bendrick | 174/94 |
| 3,706,121 | 12/1972 | Gillespie | 29/203 H |
| 4,169,646 | 10/1979 | Stape et al. | 339/99 R |
| 4,192,571 | 3/1980 | Strautz | 339/103 M |
| 4,241,970 | 12/1980 | Rider et al. | 339/99 R |
| 4,345,811 | 8/1982 | Volka | 339/143 R |

*Primary Examiner*—John McQuade
*Assistant Examiner*—David L. Pirlot
*Attorney, Agent, or Firm*—Russell J. Egan

[57] ABSTRACT

A shielding assembly is disclosed for enclosing an electrical connector terminating fully shielded cable, with the shielding assembly terminating the shielding of the cable. The subject shielding assembly completely encloses the connector and provides a ground path for the shielding of the cable to an equipment cabinet and the like.

7 Claims, 3 Drawing Figures

SHIELDING ASSEMBLY ENCLOSING AN ELECTRICAL CONNECTOR TERMINATING SHIELDED CABLE

The present invention relates to a shielding assembly to be used in enclosing a connector terminating fully shielded cable and provide ground path for the shielding of the cable.

There are a number of problems in terminating shielded cable. Part of the problem is involved with the actual handling of the cable to separate the conductors from the shielding layer or layers, and another part is how to terminate the shielding in such a manner as to effectively form a ground path between the shielding and an equipment housing or the like. An explanation of termination problems for cable having shielding on a single side and a solution are found in U.S. Pat. No. 4,169,646. Cables shielded on both sides require a completely different solution. The schemes for providing a ground path for double sided or fully shielded cable that have heretofore been practiced have proved to be quite unsatisfactory in that they are clumsy in appearance and difficult to perform. The present invention concerns a shielding assembly to be used in cooperation with an existing connector, the connector terminating the conductors of the shielded cable with the subject shielding assembly both enclosing the connector and terminating both shielding layers providing a ground path between the cable shielding and an equipment enclosure or the like. The subject shielding assembly is provided by a pair of mating metallic housing members which define an enclosure receiving the connector therein, and a pair of crimpable cable shield terminating extensions each integral with a respective housing member.

An embodiment of the invention will now be described by way of example with reference to the accompanying drawings, in which.

Figure 3:
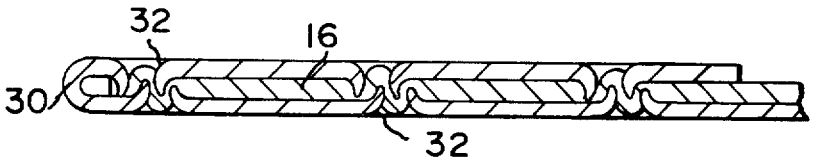
FIG. 3 is a partial transverse section taken along line 3—3 of FIG. 2 and showing the termination of the shielding of the cable.

The subject invention is shown in combination with a known connector 10 terminating a shielded cable 12. The connector 10 is of the known type, such as disclosed in U.S. Pat. No. 4,241,970, the disclosure of which is incorporated herein by reference. The cable 12 is a fully shielded type having a plurality of conductors 14 in an insulative web having shields 16, 18 on opposite sides and enclosed an outer insulative jacket 20. The shields 16, 18 can be either a thin metal foil or a metal mesh. The subject shielding assembly includes a top housing 22 and a bottom housing 24 both of which are seamless formed metallic members as shown which interfit to together define a cavity 26 of sufficient size and dimension to receive the connector 10 therein. The housing members can be dimensioned for a force fit, as shown, or with a somewhat looser fit with detents (not shown) formed to secure the members together. The bottom housing 24 has a profiled aperture 28 providing access to the mating face of the connector 10. The top housing 28 has a cable shield engaging portion 30 which is formed in a T-shape with a plurality of flanged apertures 32 formed along the cross bar portion thereof. The bottom cover 24 has a similar T-shaped extension 34 with a like plurality of flanged apertures 36. The flanged apertures 32, 36 are perforations formed to have a plurality of pyramidal tangs or ears about the perforations. The outer surfaces of the tangs are substantially parallel to the axis of the aperture and the cross bar portions containing the tangs are separated by a medial portion which is imperforate. The apertures are slightly offset so that the upper tangs will fit into the lower perforation ane vice versa, as shown in FIG. 3, so that the tangs puncture the shielding and sandwich the shielding therebetween. This type of termination is more fully disclosed in U.S. Pat. Nos. 3,138,658; 3,247,316; 3,504,101; 3,541,226; 3,541,227 and Re 27,743, the disclosures of which are incorporated herein by reference.

The individual top and bottom housing members are used to terminate the shielding of the cable as shown in FIG. 3 by folding the arms of the T-shaped extension upon itself and bringing them into interlocking engagement as shown in FIG. 3. This engagement has the flanges of the respective apertures 32, 36 engaging with like apertures from opposite sides of the shielding to form a tight gripping relation. A crimping die which could be used to effect this termination is shown in U.S. Pat. No. 3,706,121, the disclosure of which is incorporated herein by reference. When the two layers of shielding are terminated, the shielding members 22, 24 are assembled onto the connector 10 to provide a completely enclosed shield thereabout while providing grounding for shielding of the cable. The shielding members 22, 24 can be secured in place by conventional hardward 38, 40.

I claim:

1. A shielding assembly for fully enclosing an electrical connector and terminating shielding layers of a fully shielded cable, said shielding assembly comprising:

a pair of seamless formed mating metal housing members together defining a full enclosure for an electrical connector, one of said housing members defining an aperture providing access to a mating face of said electrical connector, each said housing member having an integral T-shaped extension with a plurality of flanged apertures formed in a cross bar portion thereof, said apertures being slightly offset with respect to each other in a superimposed condition, whereby crimping end portions of said cross bar upon itself causes said flanged apertures to penetrate a shielding layer from opposite sides forming a sandwich with flanges of one side engaging apertures of the other side and vice versa.

2. A shielding assembly according to claim 1 further comprising:

means to hold said housing members together in an assembled condition.

3. A shielding assembly according to claim 1 further comprising:

means to hold said housing members and said connector together in an assembled condition.

4. A shielding assembly according to claim 1 wherein each said flanged aperture comprises:

a plurality of tangs surrounding each respective aperture and extending out of the plane of said cross bar portion.

5. A shielding assembly according to claim 1 wherein: said housing members mate together with friction fit to form an electrically sealed enclosure.

6. A method of terminating fully shielded cable in which a plurality of conductors arranged in parallel spaced relation are sandwiched between layers of conductive shielding material and enclosed in an insulative sleeve comprising the steps of:

removing a portion of said sleeve to expose said shielding layers, peeling back said shielding layers to expose said conductors, terminating said conductors to respective terminals of an electrical connector, terminating each said shielding layer to a respective half of a seamless formed mating metal housing shell member, and fully enclosing said electrical connector in said formed mating metal housing shell members.

7. A method according to claim 6 wherein said shielding layers are terminated by the steps of placing each of them on an extension of a respective said one of said metal housing shell members, each said extension having a plurality of flanged apertures therein, and folding said extensions upon themselves so as to sandwich said shielding layer between portions thereof, said aperture flanges penetrating said shielding layer from one side to engage in apertures on the other side and vice versa.

* * * * *

UNITED STATES PATENT AND TRADEMARK OFFICE

CERTIFICATE OF CORRECTION

PATENT NO. : 4,420,201

DATED : December 13, 1983

INVENTOR(S) : Brian D. Stephenson

Figure 1:
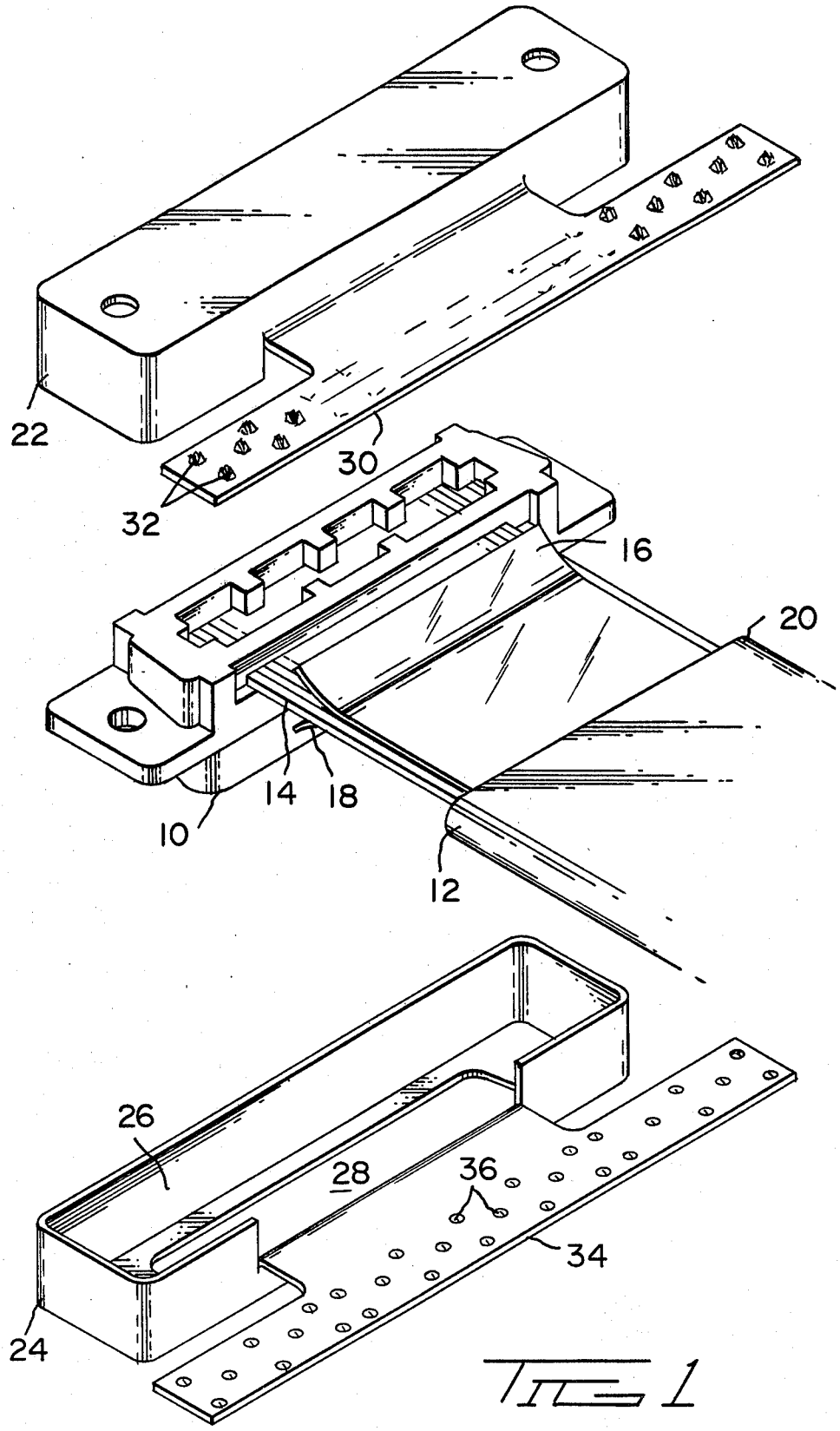
FIG. 1 is an exploded perspective view of the subject invention together with a known connector terminating the conductors of a shielded cable.
Figure 2:
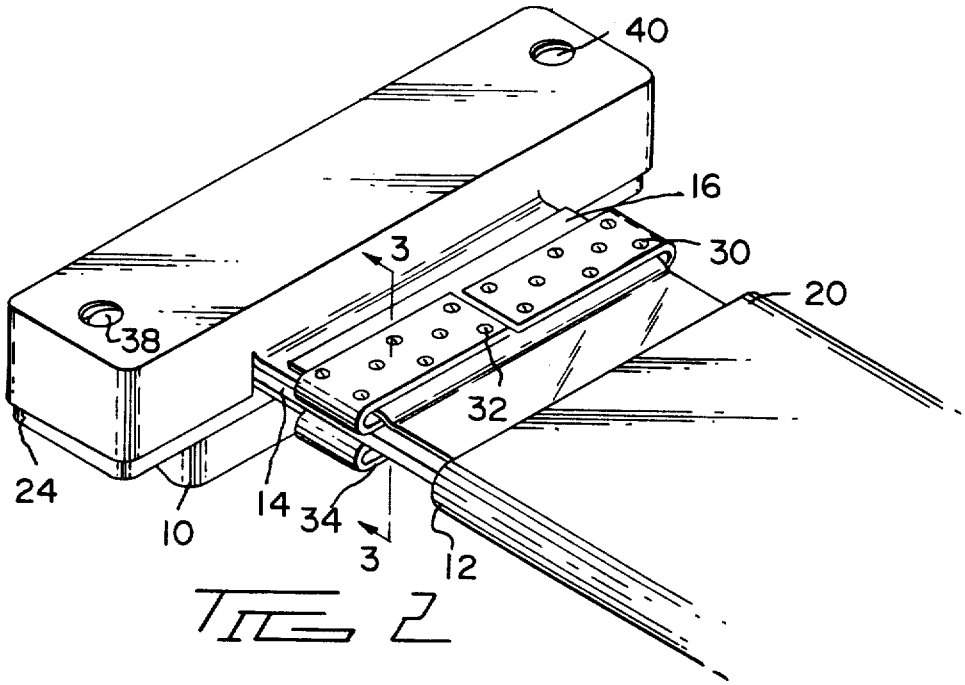
FIG. 2 is a perspective view of the fully assembled shielding assembly of the present invention terminating the shielding layers of a shielded cable.

It is certified that error appears in the above-identified patent and that said Letters Patent is hereby corrected as shown below:

FIGURES 2 and 3 should be added as shown on the attached sheet.

Signed and Sealed this

*Twenty-third* Day of *October 1984*

[SEAL]

*Attest:*

GERALD J. MOSSINGHOFF

*Attesting Officer*

*Commissioner of Patents and Trademarks*

Patent No. 4,420,201 December 13, 1983

Brian D. Stephenson